United States Patent [19]

Pendleton

[11] 4,349,961

[45] Sep. 21, 1982

[54] REMOVABLE CHISEL BLADE

[76] Inventor: Harlan C. Pendleton, 1606 12th Ave. West, Seattle, Wash. 98119

[21] Appl. No.: 306,752

[22] Filed: Sep. 29, 1981

Related U.S. Application Data

[63] Continuation-in-part of Ser. No. 200,955, Oct. 27, 1980, abandoned.

[51] Int. Cl.[3] ..... B26B 3/00

[52] U.S. Cl. ..... 30/168; 30/342; 145/24

[58] Field of Search ..... 30/168, 340, 342; 145/24, 25, 26

[56] References Cited

U.S. PATENT DOCUMENTS

| | | | |
|---|---|---|---|
| 54,189 | 4/1866 | Merriam | 30/342 |
| 181,676 | 8/1876 | Hastings | 30/342 |
| 382,591 | 5/1888 | Cowles | 30/342 |

FOREIGN PATENT DOCUMENTS

| | | | |
|---|---|---|---|
| 328331 | 4/1903 | France | 30/340 |
| 334617 | 10/1903 | France | 30/340 |
| 1041178 | 10/1953 | France | 30/168 |
| 831212 | 3/1960 | United Kingdom | 30/340 |

*Primary Examiner*—Stephen G. Kunin
*Assistant Examiner*—J. T. Zatarga
*Attorney, Agent, or Firm*—Seed, Berry, Vernon & Baynham

[57] ABSTRACT

Having a beveled prying edge and a notch for frictional interfitting with a chisel shaft, the removable chisel blade of this invention provides a significant improvement to the process of removing mortar leakage, grout, or spalling from the surfaces of concrete walls. The heat-treated, hardened steel blades have a sharp edge to pry the grout drippage from the surfaces without driving the grout into the surface and without biting into the surface itself. A notch is cut in the body of the blade so that the blade will slide into a throat on a chisel shaft and will frictionally interfit through wedging action with the chisel shaft. Beveled side portions of the tapered notch sides provide improved frictional interfitting. Also, beveled inset grooves on the body of the chiseled blade provide improved frictional interfitting and reduce the tendency of the chisel blade to wiggle in the plane of the blade.

9 Claims, 6 Drawing Figures

REMOVABLE CHISEL BLADE

DESCRIPTION

CROSS-REFERENCE TO RELATED APPLICATIONS

This application is a continuation-in-part application of U.S. patent application Ser. No. 200,955 filed Oct. 27, 1980, now abandoned.

TECHNICAL FIELD

This invention relates to a removable chisel blade useful primarily in the concrete trade, where chiseling is done to remove concrete mortar leakage, grout, or spalling from the surfaces of concrete walls.

BACKGROUND ART

When a concrete ceiling is poured, grout often leaks onto the concrete walls below, causing a film of grout to solidify on the surfaces of the walls. This grout film must be removed from the walls prior to finishing. Ordinarily, the task of the removing the film is costly and time-consuming. Cold chisels are often used to hammer the major grout drippage from the surfaces. However, cold chisels become dull quickly when ground thin enough to pry mortar. Furthermore, the thickness of the cold chisel blade prevents use of the chisel at the best working angle, so the blade tends to dig into the surface of the wall or to drive the grout film into the surface rather than to pry the grout film from the surface.

DISCLOSURE OF INVENTION

A removable chisel blade of this invention eases the task of removing concrete mortar spillage, grout, or spalling from the surfaces of concrete walls. The lightweight blade has a generally planar, metal body having a beveled prying edge on one end. Laterally opposite the beveled prying edge is a notch for frictional, removable interfitting and wedging of the body with a chisel shaft. The notch preferably includes inwardly tapering side portions having beveled leg sections. These side portions substantially improve the frictional interfitting of the body and shaft by increasing the surface area in contact between the body and shaft. To reduce movement of the blade in the shaft in the plane defined by the body of the blade, grooves are preferably beveled into both the top and bottom surfaces of the body at the end of the notch. Thus, when the removable chisel blade of this invention is interfit with a chisel shaft, the side portions will provide frictional interfitting, while the inset groove will substantially eliminate wiggle of the blade. End portions projecting outwardly from the chisel shaft on either side allow easy removal of the removable chisel blade from the chisel shaft by hammering on the end pieces substantially parallel to the centerline of the chisel blade.

When dull or broken, the blade may be removed and replaced at the site, or the blade may be removed and reground. The blade is relatively thin, having a thickness for the body less than about 0.125 inch (0.32 cm), and is formed from roll-hardened, heat-treated steel having a Rockwell hardness of about 40. Cold chisels generally have a Rockwell hardness of approximately 54. Therefore, cold chisels quickly dull or break when used to remove grout from wall surfaces. The preferred blade of this invention is heat-treated near the spring temper hardness of the steel to provide a durable blade.

Use of thin, hardened spring steel allows sharpening of the blade like a wood chisel so that the chisel acts much like a razor blade removing paint from glass. The operation of removing grout drippage from concrete walls is substantially improved.

BEST MODE FOR CARRYING OUT THE INVENTION

Figure 1:
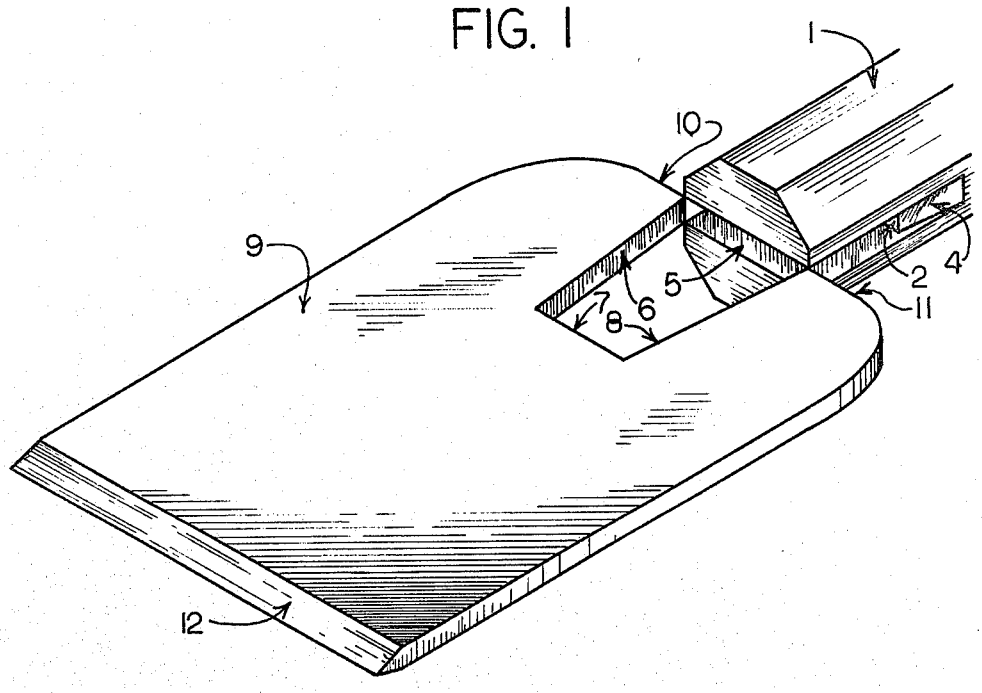
FIG. 1 is a perspective view of a blade and chisel shaft according to this invention.
Figure 2:
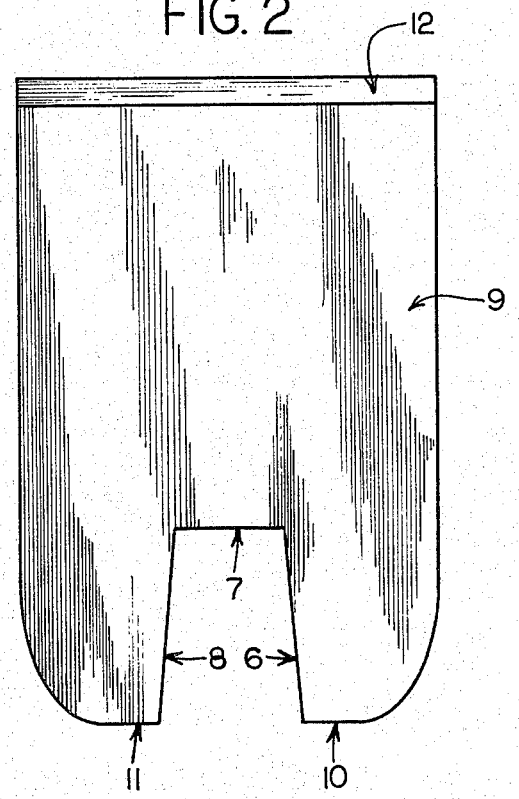
FIG. 2 is a top plan view of the blade of FIG. 1.
Figure 3:
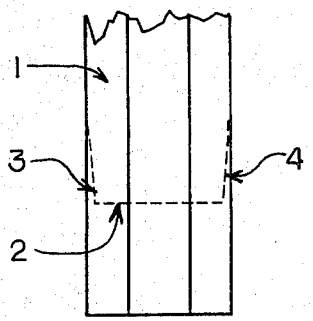
FIG. 3 is a top plan view of the chisel shaft of FIG. 1.
Figure 4:
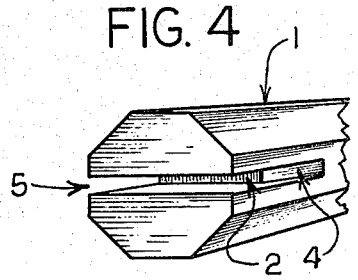
FIG. 4 is a perspective view of the chisel shaft of FIG. 1.

A removable chisel blade is ordinarily used with a common chisel shaft, as shown in FIG. 1. The chisel shaft 1 has a throat 5, including a backstop surface 2 and tapered throat sides 3 and 4 in FIG. 3. The preferred chisel blade has a body portion 9, a beveled prying edge 12, and a notch portion laterally opposite the prying edge 12. As shown in FIGS. 1 and 2, the notch portion includes notch sides 6 and 8 and a notch end 7. The notch and throat 5 are shaped accordingly so that the notch end 7 substantially abuts the backstop surface 2 of the throat 5 when the removable chisel blade is positioned on the chisel shaft 1. At this time, respective notch sides 6 and 8 will substantially abut the tapered throat sides 3 and 4. This arrangement of tapered surfaces provides for wedging of the chisel blade into the chisel shaft 1 and holds the chisel blade substantially snug in the throat 5 of the chisel shaft 1. As the chisel is used, the blade will tend to wedge more snugly into the throat 5 as it is driven backwardly and more firmly into the throat 5. Body ends 10 and 11 extend past the throat 5 on the sides of the chisel and provide surface for easy removal of the chisel blade from the chisel shaft 1. Hammering on either surface 10 or 11 in a direction substantially parallel to the centerline of the chisel shaft 1 will knock the body 9 from its frictional interfitting with the chisel shaft 1.

Figure 5:
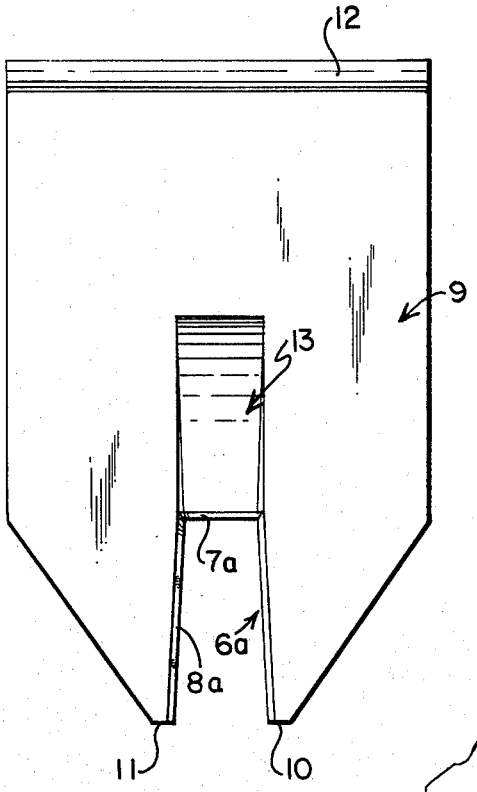
FIG. 5 is a top plan view of a preferred blade of this invention.
Figure 6:
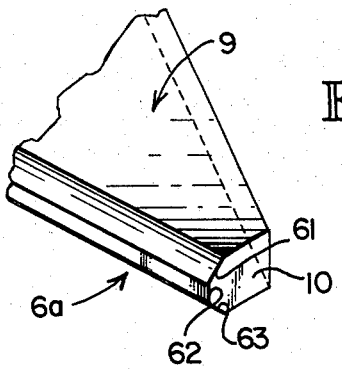
FIG. 6 is a partial perspective view of the blade of FIG. 5.

As shown in FIGS. 5 and 6, the preferred chisel blade of this invention has further features to improve its frictional interfitting with the chisel shaft 1. In particular, the side portions **6*a* and 8*a* preferably include trapezoidal beveled edges. Notch side 6*a* has a first leg portion 61 slanting inwardly and downwardly to intersect a second leg portion 62, which projects downwardly substantially perpendicular to the plane of the upper surface of the body 9. The second leg 62 intersects a third leg 63, which projects outwardly and downwardly to intersect with the lower surface of the body 9. Thus, in cross-section, the improved notch sides 6*a* and 8*a* are trapezoidal. The notch sides 6*a* and 8*a* have three planar surfaces for contact with respectively counter-grooved surfaces on the chisel shaft 1, thereby improving the frictional interfitting of the body 9 with the chisel shaft 1**.

On the body 9, and substantially adjacent the notch end **7*a*, beveled inset grooves 13 are ground on the upper and lower surfaces of the body 9. For a 3/32-inch thick chisel blade, the bevel inset grooves 13 are cut approximately 1/64 inch into the body 9 at the point of contact of the groove with the notch end. Thus, the notch end will be approximately 1/16 inch thick at this point. The grooves 13 taper upwardly to become flush with the principal surfaces of the body 9. These inset grooves 13 enhance the frictional interfitting of the body 9 with the chisel shaft 1 and reduce the likelihood of wiggle of the removable chisel blade with the chisel shaft 1 in the plane defined by the body 9**.

FIGS. 5 and 6 show that the body ends 10 and 11 need not be large to fulfill their function of being bearing surfaces for removal of the blade from its positioning in the throat 5 of the chisel shaft 1. FIGS. 5 and 6 also show that the preferred beveled edge 12 of the chisel blade of this invention projects downwardly from the upper surface of the body 9 in one plane to intersect the lower surface of the body 9. That is, the preferred beveled edge 12 is formed by the intersection of a single plane with the plane defined by the body 9 of the chisel blade.

The improved chisel blade of this invention is preferably thin, having a maximum thickness less than about 0.125 inch (0.32 cm). In practice, the blade will commonly be about 3/32-inch thick and will be made from heat-treated, hardened steel. The steel preferably has a Rockwell hardness of about 40 and is heat-treated near the spring temper hardness of the steel (which is ordinarily between a Rockwell hardness of about 44–48). Using this heat-treated spring steel is a significant improvement over existing cold chisels. The steel is resilient and is more easily sharpened to a durable, sharp edge. The edge retains its sharpness much longer than that of a cold chisel because a cold chisel generally has a Rockwell hardness of approximately 54. Conventional cold chisels are further hindered insofar as their thickness does not allow sharpening of the edge to the desired edge without unduly brittling the chisel blade. To use a cold chisel requires either a substantial capital cost to provide a sufficient inventory of chisels at the site, or leads to significant shutdowns during the finishing of concrete walls due to the time necessary to resharpen the blunted blades. The hardened steel, removable chisel blades of this invention are a significant improvement and last for up to forty hours in actual operation. When blunted, the blades are almost immediately replaceable. The lightweight nature of the blades allows for their being easily carried by workmen. Little or no shutdown time is involved in using the removable chisel blades of this invention.

I claim:

1. A removable chisel blade capable of cleaning grout drippage from the surface of a concrete wall, comprising:

(a) a generally planar, metal body;

(b) a beveled prying edge on one end of the body; and (c) a notch on the body, laterally opposite the edge, allowing frictional, removable interfitting and wedging of the body with a chisel shaft;

wherein the notch includes inwardly tapering side portions to improve the frictional interfitting and wedging of the body ahd shaft; and wherein the body includes beveled inset grooves at the end of the notch to enhance the frictional interfitting and wedging of the body and shaft and to reduce movement of the blade in the plane defined by the body.

2. The blade of claim 1 wherein the side portions include beveled edges to improve the frictional interfitting of the body and shaft by increasing the surface area in contact between the body and shaft.

3. The blade of claim 2 wherein the edges of the side portions have a first leg slanting inwardly and downwardly from an upper surface of the body, a second leg intersecting the first leg and extending downwardly substantially perpendicular to the plane of the body, and an outwardly and downwardly slanting third leg intersecting the second leg and a lower surface of the body.

4. The blade of claim 1 wherein the blade is made from steel having a Rockwell hardness of about 40.

5. The blade of claim 1 wherein the blade is heat-treated.

6. The blade of claim 5 wherein the heat treating is done at around the spring temper hardness of the steel.

7. The blade of claim 1 wherein the body is less than about 0.125-inch (0.32 cm) thick to allow a lower angle of attack for the blade, providing improved prying of grout drippage from the surface and reducing the likelihood of the blade's biting into the surface of the wall.

8. A removable chisel blade capable of cleaning grout drippage from the surface of a concrete wall, comprising:

(a) a generally planar body having upper and lower surfaces and made from heat-treated steel having a Rockwell hardness of about 40;

(b) a beveled, substantially straight prying edge on one end of the body;

(c) a notch, laterally opposite the edge, allowing frictional, removable interfitting and wedging of the body with a chisel shaft, and including inwardly tapering side portions having beveled edges comprising a first leg which slants inwardly and downwardly from the upper surface of the body to contact a second leg which projects downwardly substantially perpendicular to the plane of the body to contact a third leg which slants outwardly and downwardly to end at the lower surface of the body; and (d) tapered inset grooves on the body at the end of the notch to enhance the frictional interfitting and wedging of the body and shaft and to reduce movement of the blade in the plane defined by the body.

9. The blade of claim 1 or claim 8 wherein the edge comprises a generally planar portion slanting downwardly from the upper surface of the body to intersect the lower surface of the body.

* * * * *